United States Patent [19]

Nishino et al.

[11] Patent Number: 4,587,402

[45] Date of Patent: May 6, 1986

[54] PLANAR HEATING UNIT

[75] Inventors: Atsushi Nishino, Neyagawa; Masaki Ikeda, Hirakata; Yoshihiro Watanabe, Moriguchi; Tadashi Suzuki, Katano, all of Japan

[73] Assignee: Matsushita Electric Industrial Co., Ltd., Osaka, Japan

[21] Appl. No.: 588,877

[22] PCT Filed: Jun. 23, 1983

[86] PCT No.: PCT/JP83/00203

§ 371 Date: Feb. 22, 1984

§ 102(e) Date: Feb. 22, 1984

[87] PCT Pub. No.: WO84/00275

PCT Pub. Date: Jan. 19, 1984

[30] Foreign Application Priority Data

Jun. 24, 1982 [JP] Japan ..... 57-109419
Oct. 29, 1982 [JP] Japan ..... 57-191649
Jan. 18, 1983 [JP] Japan ..... 58-6311

[51] Int. Cl.[4] ..... F24H 9/00

[52] U.S. Cl. ..... 219/343; 219/345; 338/308

[58] Field of Search ..... 219/345, 346, 342, 343, 219/375, 366, 520, 521, 522, 523, 525; 338/308

[56] References Cited

U.S. PATENT DOCUMENTS 3,737,624 6/1973 Ellenberger ..... 219/345 X
3,805,024 4/1974 Joeckel et al. ..... 219/345 X

FOREIGN PATENT DOCUMENTS 39-485 1/1964 Japan .
40-25659 9/1965 Japan .
51-687 1/1976 Japan .

*Primary Examiner*—C. L. Albritton
*Assistant Examiner*—M. M. Lateef
*Attorney, Agent, or Firm*—Wenderoth, Lind & Ponack

[57] ABSTRACT

A planar heating unit comprises a base plate (1) having a surface electrically insulated by an insulation enamel layer (2*a*) or the like, a heating conductor (3) placed on the insulation surface of the base plate for generating Joule heat, and an enamel layer (4) fixing the heating conductor to the base plate (1) and covering the upper surface of the heating conductor.

10 Claims, 9 Drawing Figures

3

3

PLANAR HEATING UNIT

TECHNICAL FIELD

The present invention relates to a heating unit which generates Joule heat upon energization, and more particularly to a planar heating unit wherein an assembly including a heating conductor, a base plate supporting the same, etc. is constructed in the form of a plate whose surface radiates infrared rays.

BACKGROUND ART

Planar heating units are used as a heat source for heating equipment, cooking appliances, and driers and are attracting attention because they meet such requirements as the reduction of apparatus thickness and uniform heating.

Requirements which planar heating units should meet are as follows.

(1) Superior function of radiating far infrared rays, and high efficiency of energy utilization.
(2) Superior processing dimensional accuracy.
(3) Low heat capacity.
(4) Easy of leading out the terminals.
(5) Capable of uniformly heating objects.
(6) High heat resistance and moisture resistance.
(7) Superior electrical characteristics (insulation resistance and dielectric breakdown strength).
(8) Little variation in the resistance value of heating conductors.

Most of the conventional planar heating units are in the form of a mica or other insulation base plate having a heater wound thereon and are poor in transmission of heat to heating loads, and since their electric heating material is not sealed, there has been a problem in their moisture resistance.

There is another form of planar heating unit wherein a nonsintered sheet, such as alumina, is formed with an electrically conductive pattern using a conductor paste, such as tungsten, with a sheet stuck thereto, and the assembly is sintered. This heating unit is suitable for applications requiring high heat value, but presents such problems as high heat capacity which results in a long heat-up time, and high sintering temperature which makes it difficult to lead out the electrodes because of the melting of contact material.

There are other forms of heating units including one in which an electrically conductive pattern formed between silicone resin, polyimide or other organic films and the heating unit is constructed as by lamination, but these heating units are limited in heat resistance temperature to 250° C. and their service life is also limited.

DISCLOSURE OF INVENTION

A planar heating unit according to the present invention comprises a base plate having an electrical insulation surface, a Joule heat generating conductor disposed on said electrical insulation surface, and a cover layer formed of an enamel layer for fixing said conductor to said base and covering said conductor.

This arrangement makes it possible to provide a planar heating unit which is superior in heat resistance and moisture resistance and whose heat capacity is low. Further, the function of the enamel layer ensures a high infrared radiation coefficient and high efficiency of energy utilization.

BEST MODE FOR CARRYING OUT THE INVENTION

Figure 1:
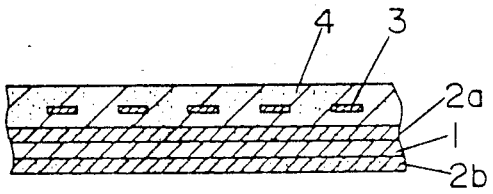
FIG. 1 is a fragmentary sectional view showing an embodiment of the arrangement of the planar heating unit of the present invention.

FIG. 1 shows an example of the basic arrangement of the planar heating unit of the present invention. In this figure, 1 denotes an enameling metal base plate whose surfaces are covered with insulation enamel layers 2*a* and 2*b* in advance. The numeral 3 denotes a planar heating conductor disposed above one enamel layer 2*a* and covered with a cover enamel layer 4 formed by spraying an enamel layer-forming slip onto the enamel layer 2*a* and firing the same, said conductor being integral with the base plate.

Figure 2A:
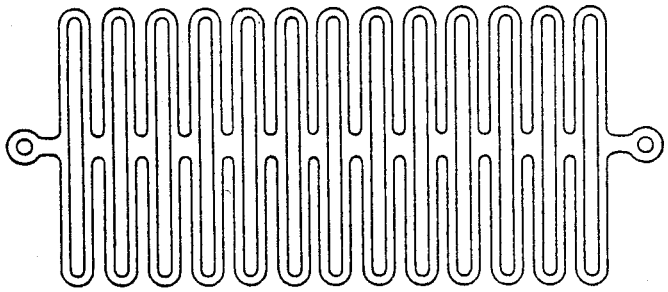
FIGS. 2(*a*) and 2(*b*) are plan views showing heating conductors in the planar heating unit of the invention.
Figure 2B:
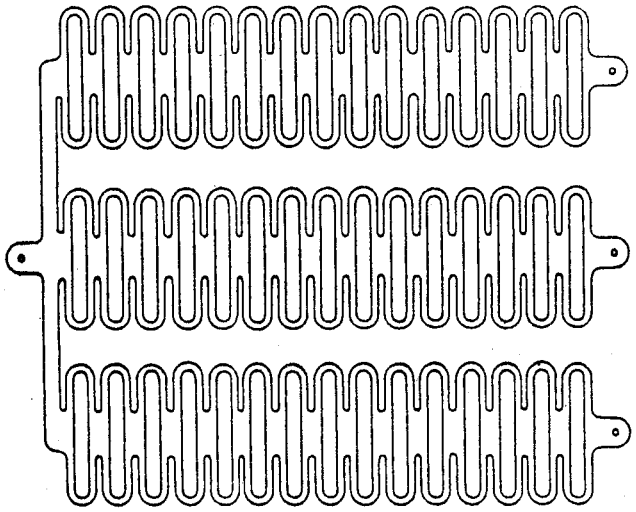

The planar shape of the heating conductor 3 may be for example as shown in FIG. 2(*a*) or FIG. 2(*b*).

The planar heating unit of FIG. 1 can be produced by the following process.

First, a steel plate forming the base plate 1 is subjected to degreasing, boiling wash, pickling, and boiling wash, and then to nickel plating, boiling wash, and drying. This operation is followed by spraying an enamel slip onto both surfaces of the thus obtained base plate 1, drying, and firing to provide primary enamel layers which form the insulation enamel layers 2*a* and 2*b*. Subsequently, the enamel slip is sprayed onto one surface of said enamel layer 2*a*, a thin metal strip of predetermined pattern serving as the heating conductor 3 is laid. This operation is followed by spraying additional enamel slip onto said metal strip, drying, and firing. In this way, a planar heating unit is obtained in which the thin metal strip is covered with the cover enamel layer 4 and is integral with the base plate.

The components of the planar heating unit of the present invention will now be described in detail.

(1) Base plate

The steel plate which forms the base plate is preferably a low carbon steel plate containing 0.001–0.1% by weight of carbon. Even if a low-softening point frit is form the enamel layer, the temperature of the base plate during enamel firing exceeds 600° C. and hence the carbon in the steel plate is liberated as CO or $CO_2$, thus forming voids in the enamel layer and degrading the insulation property of the enamel layer. If the carbon content of the steel plate exceeds 0.05% by weight, the amount of voids in the enamel layer increases and the insulation property is degraded. However, it is difficult to remove the carbon in the steel plate and it is not practical from the standpoint of production and cost to decrease the carbon content below 0.001%.

Further, the steel plate is subjected to pickling as a pretreatment, but if the carbon content is minimized, as described above, the weight loss on pickling does not become fixed, which is undesirable from the standpoint of production control and adhesion. The weight loss on pickling is related to the amounts of copper and phosphorus, and it is possible to make constant the weight loss on pickling by adjusting the copper content between 0.005 and 0.04% by weight and the phosphorus content between 0.01 and 0.02% by weight.

As for conditions for pickling, a weight loss of 100–500 mg/dm$^2$ is suitable. With less than 100 mg/dm$^2$, sufficient adhesion cannot be expected at the enamel firing temperature using a low-melting point frit. If pickling is performed to the extent which results in weight loss greater than 500 mg/dm$^2$, the amount of atomic hydrogen absorbed in the steel plate during pickling increases and forms voids in the enamel layer when it is liberated from the steel plate during enamel firing.

Even if the steel plate is pickled as described above, the direct formation of the enamel layer will result in the tendency of the enamel layer to peel off the steel plate because of heat cycles due to the repeated use of the planar heating unit since the base plate, enamel layer, and thin metal strip differ in thermal expansion coefficient.

To increase the adhesion between the steel plate and the enamel layer, the steel plate, after pickling, is formed with nickel. The nickel layer is preferably formed by plating, and the coating build-up is suitably not more than 20 mg/dm$^2$ and preferably 3–20 mg/dm$^2$. If the nickel coating build-up is too small, the bond strength between the enamel layer and the base plate is low and repeated heat cycling will crack the enamel layer and lower the insulation resistance. On the other hand, too large coating build-up will cause a drawback that the amount of hydrogen gas evolved during enamel firing increases.

(2) Enamel layer

As for the frit used for the enamel layer which forms the insulation layer and cover coating layer, common high temperature frits may be used. However, to suppress the amounts of carbon dioxide and hydrogen evolved from the base plate and thin metal sheet during enamel firing, to make it possible to use plates as thin as 0.3–0.6 mm for the base plate without thermal deformation, and to improve dimensional accuracy, the use of low-softening point frits is preferable. The softening points of preferable frits are 470°–650° C. and they make it possible to adjust the enamel firing temperature to 670°–740° C.

Typical low-softening point frit compositions are shown in Table 1 and concrete examples thereof are given in Table 2. The softening points of the frits shown in Table 1 are in the range of 510°–590° C.

TABLE 1

| Composition | Frit: Titania opacified frit | Frit: Transparent frit |
|---|---|---|
| $SiO_2$ | 30–36% by weight | 31–39% by weight |
| $B_2O_3$ | 15–20% by weight | 13–22% by weight |
| $Na_2O$ | 7–9% by weight | 14–22% by weight |
| $K_2O$ | 7–15% by weight | 1–5% by weight |
| CaO | | |
| $Li_2O$ | | |
| ZnO | | 13–20% by weight |
| $Al_2O_3$ | | 0–5% by weight |
| $ZrO_2$ | 5–10% by weight | 0–5% by weight |
| $TiO_2$ | 10–17% by weight | 0–5% by weight |
| $P_2O_5$ | 0.5–2.5% by weight | |

TABLE 1-continued

| Composition | Frit: Titania opacified frit | Frit: Transparent frit |
|---|---|---|
| $F_2$ | 2–10% by weight | 2–10% by weight |
| Linear expansion coefficient ($\times 10^7$ deg$^{-1}$) | 90–110 | 100–130 |
| Working temperature (°C.) | 650–720 | 630–710 |

TABLE 2

| Composition | Frit 1 | Frit 2 |
|---|---|---|
| $SiO_2$ | 34% by weight | 35% by weight |
| $B_2O_3$ | 17% by weight | 17% by weight |
| $Na_2O$ | 9% by weight | 19% by weight |
| $K_2O$ | 10% by weight | 2% by weight |
| $Li_2O$ | | |
| CaO | 1% by weight | |
| ZnO | | 16% by weight |
| $Al_2O_3$ | | 3% by weight |
| $ZrO_2$ | 8% by weight | 2% by weight |
| $TiO_2$ | 12% by weight | |
| $P_2O_5$ | 2% by weight | |
| $F_2$ | 7% by weight | 6% by weight |
| Linear expansion coefficient ($\times 10^7$ deg$^{-1}$) | 100 | 115 |
| Working temperature (°C.) | 700 | 690 |

The compositions of typical enamel glazes are given by way of example in Table 3.

TABLE 3

| | a | b | c |
|---|---|---|---|
| Frit (No. 1 in Table 2) | 100 | 100 | 100 |
| Clay | 6 | 5 | 5 |
| $NaNO_2$ | 0.3 | 0.3 | 0.3 |
| $Al_2O_3$ | — | 20 | 20 |
| NiO | — | — | 7 |
| Pigment | 0–3 | 0–3 | 0–3 |
| Water | 45 | 60 | 63 |

The character a refers to a composition used for the usual glazed enamel finish which exhibits a gloss of not less than 80; the amount of pigment to be added may be varied according to desired color and color tone. The character b refers to an example in which $Al_2O_3$ is added in order to improve electrical insulation property; other insulation property improvers include $TiO_2$, $ZrO_2$, MgO, BeO, $MgAl_2O_4$, $SiO_2$, mica, glass fiber, silica fiber, and alumina fiber.

The amount of such improver to be added depends on shape but is preferably 5–50 parts by weight with respect to 100 parts by weight of frit. If the amount is more than 50 parts by weight, the adhesion is decreased, while if it is less than 5 parts by weight, the dielectric breakdown strength cannot be increased.

The character c refers to an example in which a far infrared radiating material, NiO, is added in order to improve the far infrared radiation characteristic. Besides this, such far infrared radiating materials as $MnO_x$, $CO_3O_4$, $Cu_2O$, $Cr_2O_3$, and $Fe_2O_3$ are effective. The amount of such far infrared radiating material is preferably not more than 50 parts by weight with respect to 100 parts by weight of frit. If such material is used together with an insulation improver, the total amount should be not more than 50 parts by weight. The reason is that otherwise, peeling of the enamel layer would take place, as described above. In addition, the thermal expansion coefficient of the enamel layer is preferably in the range of 0.8–1.5 where the thermal expansion coefficient of the heating unit is taken to be 1.

(3) Heating conductor

As for the thin strip of the heating conductor, particularly Ni-Cr alloy and stainless steel SUS 430 are suitable but Fe-Cr alloy, Fe-Cr-Al alloy, and stainless steel SUS 304 may be used. Such metal is thinned by cold rolling, hot rolling or supercooling and is then subjected to a surface enlarging treatment, if necessary, in order to improve the adhesion between it and the enamel layer, and it is degreased and washed, whereupon it is processed into a predetermined pattern by press punching or etching.

The thickness of the thin strip is preferably not more than 120 μm. If it exceeds this value, the matching of thermal expansion coefficient is degraded, the heat capacity of the heating conductor itself is increased or the temperature distribution becomes nonuniform.

Table 4 shows the thermal expansion coefficients of raw materials used for the heating conductor and the thermal expansion coefficients of frits suitable for use therewith. In addition, the thermal expansion coefficient of the steel plate used as the base plate is $125\times10^7$ $deg^{-1}$.

TABLE 4

| Heating conductor | Thermal expansion coefficient ($\times10^7$ $deg^{-1}$) | Thermal expansion coefficient of Frit ($\times10^7$ $deg^{-1}$) |
|---|---|---|
| Ni—Cr alloy | 140 | 80–120 |
| Stainless steel SUS 430 | 114 | 80–100 |
| Stainless steel SUS 304 | 180 | 120–150 |
| Fe—Cr—Al alloy | 115 | 80–100 |

The result of investigation of other conditions for the production of the aforesaid planar heating unit will now be described.

For use as base plates, 0.4 mm thick 50×90 mm steel plates which contained different amounts of carbon and phosphorus were formed on their opposite surfaces with nickel plating layers of different thicknesses in accordance with the aforesaid process. Further, thin metal strips were prepared by punching 50 μm thick stainless steel SUS 430 into a pattern shown in FIG. 2(*a*), which provided 50 W.

The slip shown at a in Table 3 was sprayed onto said base plates, which were then dried and fired so as to form about 120 μm thick enamel layers on both sides. Subsequently, the same slip was applied to one surface of one enamel layer and said thin metal strip was placed thereon in the undried state, and this operation was followed by further praying of the slip, drying and firing to produce a heating unit. The distance between the base plate and the thin metal strip was about 140–160 μm, and the thickness of the enamel layer covering the thin metal strip was about 250–300 μm.

It follows that the enamel layers on the planar heating unit obtained in the manner described above contain voids due to the hydrogen and carbon dioxide evolved from the base plate and decomposition product gas from sodium nitrite which is a decomposable material in the slip. The evolution of gas from said decomposable material takes place in the initial stage of firing, and the gas is dissipated outside as the temperature increases, so that it does not so much matter. However, the gas evolved from the base plate at high temperature tends to remain in the enamel layer.

In Table 5 below, the voids are represented by High, Medium, and Low where the area occupied by the voids in a cross-section of the enamel layer between the base plate and the heating element exceeds 40%, is 20–40%, and less than 20%, respectively.

The adhesion of the enamel layer was measured by a method known as the Porcelain Enamel Institute Method (PEI method) in which recessed deformation is produced in the enamel surface under a predetermined pressure to break the enamel layer and then the bunch of needles of an adherence meter is applied to the test surface, with electric current passed therethrough to measure the percentage exposure of the blank metal to find the percentage nonexposure of the metal.

The insulation resistance of the enamel layer was measured by imposing a voltage of 500 V between the base plate and the heating element. These results are shown in Table 5.

TABLE 5

| | Base plate conditions (% by weight) | | | Pretreatment conditions ($mg/dm^2$) | | Enamel firing | Evaluation of enamel cover layer | | | |
|---|---|---|---|---|---|---|---|---|---|---|
| No. | Carbon content | Copper content | Phosphorus content | Weight loss on pickling | Amount of Ni plating | temperature (°C.) | Voids | PEI (%) | Insulation (Ω) | General evaluation |
| 1 | 0.001 | 0.02 | 0.014 | 270 | 15 | 700 | Low | 90–100 | $4\times10^8$ | o |
| 2 | 0.005 | " | " | 285 | " | " | Low | 90–100 | $9\times10^8$ | o |
| 3 | 0.01 | " | " | 280 | " | " | Low | 90–100 | $5\times10^8$ | o |
| 4 | 0.05 | " | " | 275 | " | " | Low | 90–100 | $2\times10^8$ | o |
| 5 | 0.08 | " | " | 280 | " | " | Medium | 10–90 | $8\times10^7$ | Δ |
| 6 | 0.1 | " | " | 270 | " | " | Medium | 65–85 | $1\times10^7$ | Δ |
| 7 | 0.2 | " | " | 275 | " | " | High | 60–75 | $4\times10^6$ | x |
| 8 | 0.02 | 0.005 | " | 75 | " | " | Low | 65–85 | $6\times10^7$ | Δ |
| 9 | " | 0.01 | " | 140 | " | " | Low | 85–100 | $2\times10^8$ | o |
| 10 | " | 0.02 | " | 300 | " | " | Low | 95–100 | $7\times10^8$ | o |
| 11 | " | 0.04 | " | 400 | " | " | Low | 95–100 | $5\times10^8$ | o |
| 12 | " | 0.08 | " | 600 | " | " | Medium | 65–90 | $8\times10^7$ | Δ |
| 13 | " | 0.02 | 0.005 | 45 | 12 | " | Low | 55–75 | $6\times10^7$ | Δ |
| 14 | " | " | 0.010 | 160 | 15 | " | Low | 85–100 | $3\times10^8$ | o |
| 15 | " | " | 0.015 | 330 | " | " | Low | 90–100 | $5\times10^8$ | o |
| 16 | " | " | 0.020 | 470 | " | " | Low | 85–95 | $8\times10^7$ | Δ |
| 17 | " | " | 0.030 | 780 | 18 | " | Middle | 75–90 | $3\times10^7$ | Δ |
| 18 | " | " | 0.015 | 75 | 15 | " | Low | 30–65 | $8\times10^7$ | Δ |
| 19 | " | " | " | 100 | " | " | Low | 55–80 | $4\times10^8$ | o |
| 20 | " | " | " | 200 | " | " | Low | 85–95 | $8\times10^8$ | o |
| 21 | " | " | " | 300 | " | " | Low | 86–100 | $5\times10^8$ | o |

TABLE 5-continued

| No. | Base plate conditions (% by weight) Carbon content | Copper content | Phosphorus content | Pretreatment conditions ($mg/dm^2$) Weight loss on pickling | Amount of Ni plating | Enamel firing temperature (°C.) | Evaluation of enamel cover layer Voids | PEI (%) | Insulation (Ω) | General evaluation |
|---|---|---|---|---|---|---|---|---|---|---|
| 22 | " | " | " | 400 | " | " | Low | 85–100 | $3 \times 10^8$ | o |
| 23 | " | " | " | 500 | " | " | Low | 85–100 | $2 \times 10^8$ | o |
| 24 | " | " | " | 600 | " | " | Middle | 85–95 | $9 \times 10^6$ | Δ |
| 25 | " | " | " | 300 | 0 | " | Low | 30–65 | $4 \times 10^7$ | Δ |
| 26 | " | " | " | " | 5 | " | Low | 40–80 | $8 \times 10^7$ | Δ |
| 27 | " | " | " | " | 10 | " | Low | 85–100 | $2 \times 10^8$ | o |
| 28 | " | " | " | " | 15 | " | Low | 85–100 | $4 \times 10^8$ | o |
| 29 | " | " | " | " | 20 | " | Low | 85–100 | $6 \times 10^8$ | o |
| 30 | " | " | " | " | 25 | " | Middle | 75–95 | $3 \times 10^7$ | Δ |
| 31 | " | " | " | " | 30 | " | High | 65–85 | $6 \times 10^6$ | Δ |
| 32 | " | " | " | " | 15 | 640 | Low | 65–85 | $8 \times 10^8$ | Δ |
| 33 | " | " | " | " | " | 690 | Low | 90–100 | $9 \times 10^8$ | o |
| 34 | " | " | " | " | " | 740 | Low | 90–100 | $4 \times 10^8$ | o |
| 35 | " | " | " | " | " | 790 | High | 95–100 | $7 \times 10^7$ | Δ |

Figure 3:
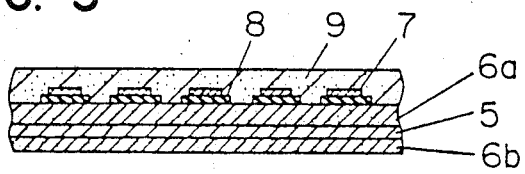
FIGS. 3 and 4 are fragmentary sectional views showing other examples of the arrangement of the planar heating unit of the invention.

FIG. 3 shows another embodiment of the invention wherein insulation enamel layers 6a and 6b are formed on the surfaces of a metal base plate 5, the upper surface of one insulation enamel layer is roughened to the extent that its surface roughness Ra is about 0.1–35 μm, an electrical insulation layer 8 whose area is about 20–30% greater than that of the pattern of the planar heating conductor is formed thereon by the spraying method using a masking, the planar heating conductor 7 being placed on said electrical insulation layer 8, and a cover enamel layer 9 is baked thereon. According to this embodiment, the provision of the electrical insulation layer 8 enables remarkable improvement of the electrical insulation characteristics in medium and high temperature regions.

Figure 4:
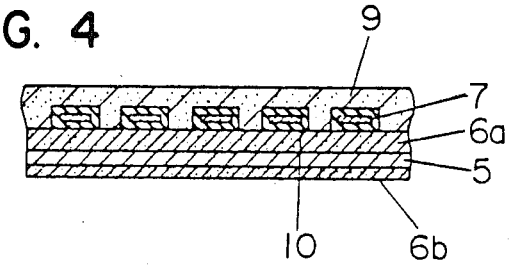

If the embodiment of FIG. 3 is modified as shown in FIG. 4 using an electrical insulation layer 10 to cover the entire peripheral surface of the heating conductor layer 7, then higher insulation performance can be obtained. In this case, the heating conductor 7 is formed on its entire peripheral surface with the electrical insulation layer 10 in advance. In addition, in FIG. 4, parts denoted by the same numerals as those of FIG. 3 are the same parts as in FIG. 3.

The materials for forming the electrical insulation layer 8 or 10 should be heat-resistant and high in volume resistivity and low in thermistor B constant; for example, alumina, zircon, cordierite, beryllia, magnesia, forsterite, steatite, mullite, boron nitride, glass ceramics, titanium oxide, and porcelain.

The embodiments shown in FIGS. 1, 3, and 4 may be selectively used according to the working temperature region of the planar heating unit. For example, the embodiment shown in FIG. 1 may be used in medium and low temperature regions below 300° C. and the embodiments shown in FIGS. 3 and 4 may be used in a high temperature region of 300°–500° C. since an electrical insulation layer is formed.

The formation of the electrical insulation layer 8 in the embodiment shown in FIG. 3 or 4 may be effected by a printing or spraying method. In the printing method, a suitable amount of glass frit serving as a binder is added to a high insulation material such as alumina or zircon to prepare printing ink for pattern printing. As for the spraying method, it is preferable to use flame spraying method, plasma spraying method, or water-stabilized plasma spraying method. Particularly, plasma spraying method will provide the best electrical insulation characteristic.

Figure 5:
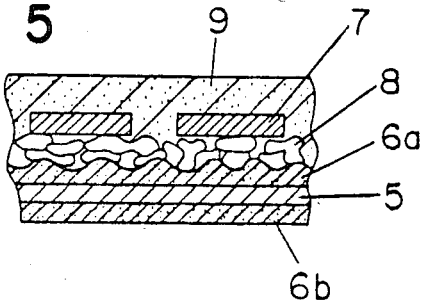
FIG. 5 is an enlarged sectional view of the principal portion of FIG. 3.

FIG. 5 is an enlarged view of the portion around the electrical insulation layer 8 of FIG. 3, showing fine particles of electrical insulation material fused together to form an electrical insulation layer. The size of the fine particles is preferably 5–120 μm and more preferably is about 30–70 μm. These particles are fused together to form a layer, the porosity being preferably about 5–30%. Further, such electrical insulation materials as alumina and zircon are about 1–2 digits lower in linear thermal expansion coefficient than the base plate metal and enamel layer, so that if a dense spray insulation layer were formed, it would be cracked by heat cycle and heat shock. Thus, the porosity should be adjusted to 5–30% according to the linear thermal expansion coefficient and particle size.

Further, the thickness of the electrical insulation layer 8, which is determined by the object, application, and the required degree of electrical insulation, is usually about 15–200 μm and is preferably about 25–60 μm from the standpoint of practical durability and practical degree of electrical insulation. The electrical insulation layer 8 can also be formed by the hot press method.

Figure 6:
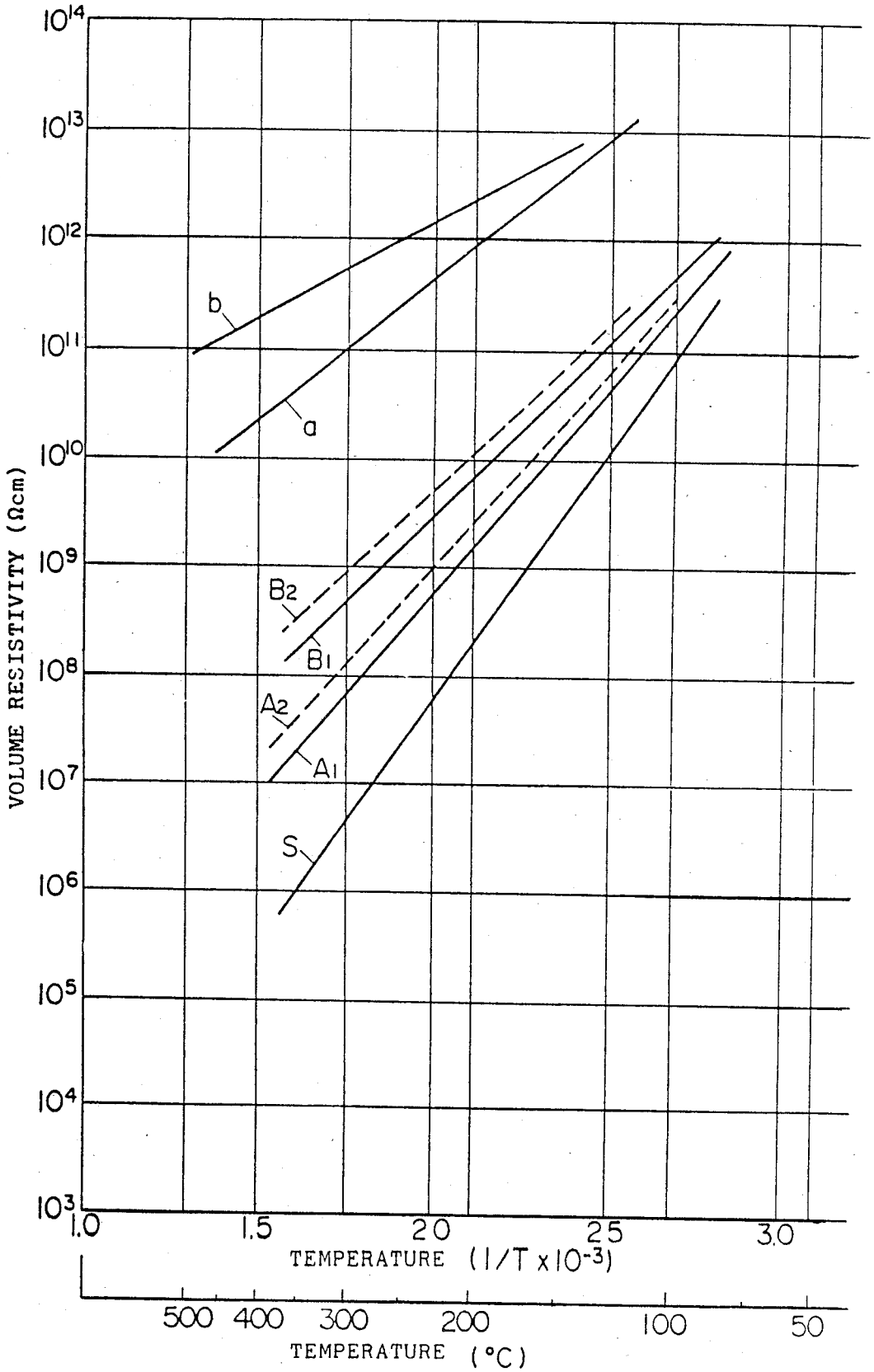
FIG. 6 is a graph showing changes in the volume resistivity of various planar heating units due to temperature.

FIG. 6 shows the relation between the volume resistivity of planar heating units using various electrical insulation layers and the reciprocal of working temperature expressed in absolute temperature T.

In FIG. 6, a and b refer to the characteristics of alumina and zircon insulation base plates, respectively, for comparison purposes. In this figure, S refers to the characteristic of a planar heating unit having the arrangement shown in FIG. 1, the glass frit used having the composition shown in Table 6.

TABLE 6

| Component | Parts by weight | Component | Parts by weight |
|---|---|---|---|
| $SiO_2$ | 45 | $Li_2O$ | 2 |
| $B_2O_3$ | 15 | $Al_2O_3$ | 10 |
| $Na_2O$ | 15 | ZnO | 5 |
| $K_2O$ | 3 | $Co_2O_3$ | 0.5 |

The character A1 refers to the characteristic of a unit using alumina as the electrical insulation material and having the arrangement shown in FIG. 3; A2 refers to the characteristic of a unit using alumina as the electrical insulation material and having the arrangement shown in FIG. 4; B1 refers to the characteristic of a unit using zircon as the electrical insulation material and having the arrangement shown in FIG. 3; and B2 refers to the characteristic of a unit using zircon and having the arrangement shown in FIG. 4.

The volume resistivity was calculated by the following equation.

$$\rho_v = \frac{A}{d} R_v$$

$\rho v$: volume resistivity
d : thickness of electrical insulation layer
A : area of heating conductor
$Rv$: insulation resistance between heating conductor and metal base plate.

In addition, the insulation resistance was measured by imposing DC 500V between the heating conductor and the metal base plate.

It is seen from FIG. 6 that the volume resistivity in A1, A2 and B1, B2 is improved by about 1–3 digits as compared with the planar heating unit S.

In addition, in the example shown in FIG. 6, the thickness of the electrical insulation layer was 40–60 μm, but if the thickness is increased, the volume resistivity can be further improved. Further, if the glass frit used in the embodiment is replaced by another glass frit having higher insulation property, it is possible to improve the volume resistivity in medium and high temperature regions of 300°–400° C. by about 2–4 digits more and to decrease the thermistor B constant.

Figure 7:
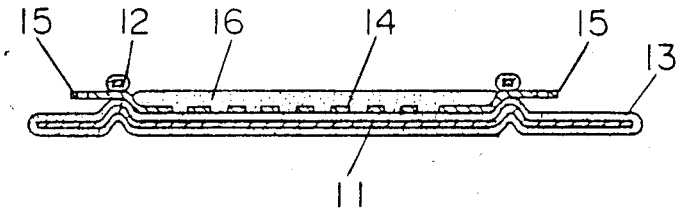
FIGS. 7 and 8 are sectional views of planar heating units according to embodiments of the invention.

FIG. 7 shows an example in which the planar heating unit of the present invention is embodied in more concrete form. The numeral 11 denotes a metal base plate formed with an upward projection 12 and covered with an enamel layer 13. The projection 12 is shaped square to cover the installation area for a heating conductor 14. The numeral 15 denotes the terminals of the heating conductor 14. A cover enamel layer 16 is installed in the region surrounded by the projection 12.

Figure 8:
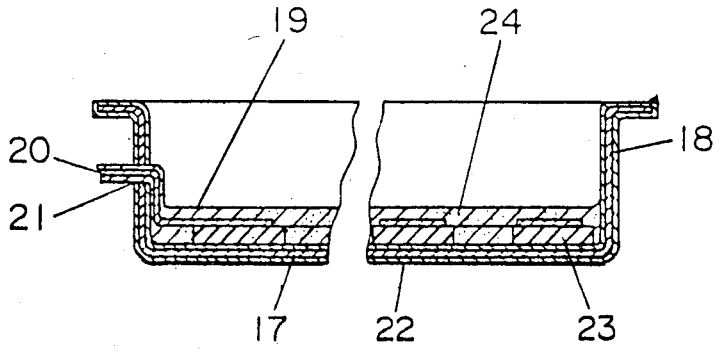

FIG. 8 shows an example in which a dish-shaped metal base plate 17 is used. The base plate 17, for example, is 0.5 mm thick, the size of its bottom 18 being 170×170 mm, the height of its upright portion being 10 mm, and it has a hole 21 in the middle for defining a lead terminal port for installing the heating lead terminals 20 of a planar heating conductor 19.

The base plate 17 is formed with an enamel layer 22 whose surface is roughened by sand blasting, and it is also formed with an electrical insulation layer 23 of 40–60 μm which is a little larger than the pattern of the planar heating conductor 19 and which is made of powder of alumina or zircon having a particle size of 30–60 μm. The heating conductor 19 is placed on the electrical insulation pattern and formed with a cover enamel layer 24.

The base plate used is one having an effective surface area of 1,000 $cm^2$ and a thickness of 0.6 mm, while the thin metal strip used is one equivalent to 1.2 KW as shown in FIG. 2 (*b*) formed of 50 μm thick stainless steel, the other conditions being the same as in No. 33 in Table 5; thus, a planar heating unit was produced. Fluorine-containing resin dispersion was sprayed onto the surface of the base plate of the heating unit, and after drying at 120° C., it was fired at 380° C. for 20 minutes to form an about 25–30 μm thick fluorine-containing resin layer, whereby a cooking plate A with the cover layer serving as a heating surface was constructed.

Table 7 shows the result of characteristic comparison between said cooking plate A and a commercially available cooking plate B having an effective surface area of about 1,000 $cm^2$ with sheathed heater embedded in an aluminum die-casting.

TABLE 7

| | Time required for the heating surface to reach 220° C. | Difference between maximum and minimum temperature of the heating surface | Power required for cooking 1 Kg of meat |
|---|---|---|---|
| A | about 45 seconds | 8.5° C. | 65 |
| B | about 4 minutes | 85° C. | 100 |

Table 7

It is seen that the cooking plate A according to the present invention is superior in heat-up characteristic and in uniform heating to the control example. Further, cooking tests were conducted to make hot cakes using this cooking plate, which exhibited no local unevenness of baking or scorching. After 1,000 continuous cooking tests, the fluorine-containing resin surface exhibited no scorching or discoloration which would otherwise develop in the area around the heater section. Thus, it was found that the cooking plate was capable of uniform long-term cooking. Further, the cooking plate requires a short preheating duration and has a low heat capacity, so that it is very economical, consuming less energy for cooking.

INDUSTRIAL APPLICABILITY

The planar heating unit of the present invention, which is excellent in insulation provided by the enamel layer and which can be constructed to have a thin wall, can be quickly and uniformly heated and is capable of far infrared heating, providing an economical heat source. Thus, it is applicable to various room heating units, driers, and cooking appliances, and particularly to infrared foot warmers and panel heaters where infrared heating is essential.

That is, because of the heat resistance of the components and the high insulation property of the cover enamel layer, the planar heating unit can be satisfactorily used at high temperatures, and since it can be constructed to have a thin wall, it is adapted for quick heat-up, and the high infrared radiating capacity of the cover enamel layer provides high efficiency.

What is claimed is:

1. A planar heating unit comprising a heat resistant metal base coated with an insulating enamel layer on at least one surface of said base, an exposed covering enamel layer fixed on said insulating enamel layer, and, as a heating conductor, a metal strip having a thickness of not more than 120 μm covered by said covering enamel layer, said metal strip being spaced apart from said insulating enamel layer.

2. A planar heating unit as set forth in claim 1, wherein said insulating enamel layer comprises a glass frit having a softening point of 470°–650° C.

3. A planar heating unit as set forth in claim 1, wherein said covering enamel layer contains an infrared radiating material.

4. A planar heating unit as set forth in claim 1, wherein said covering enamel layer comprises a glass frit having a softening point of 470°–650° C.

5. A planar heating unit as set forth in claim 1, wherein an electrical insulation material is interposed between the insulating enamel layer and said heating conductor.

6. A planar heating unit as set forth in claim 5, wherein the whole of said heating conductor is covered with the electrical insulation material.

7. A planar heating unit as set forth in claim 5, wherein said electrical insulation material is made of fine particles fused together.

8. A planar heating unit as set forth in claim 5, wherein said electrical insulation material is formed into a layer by spraying.

9. A planar heating unit as set forth in claim 1, wherein said metal base comprises a steel plate containing 0.001–0.1% by weight of carbon, 0.005–0.04% by weight of copper, 0.01–0.02% by weight of phosphorus, and a nickel layer of not more than 20 mg/dm$^2$ covering the surface of the steel plate.

10. A planar heating unit as set forth in claim 1, wherein the surface of said metal base is formed with a projection for surrounding an installation area for said heating conductor.

* * * * *